US005222643A

United States Patent [19]

Platt

[11] Patent Number: 5,222,643

[45] Date of Patent: Jun. 29, 1993

[54] HAIR TREATMENT SERVICING CONTAINER

[76] Inventor: Vanjanette C. Platt, 11780 Greenada Dr., Jacksonville, Fla. 32258

[21] Appl. No.: 740,609

[22] Filed: Aug. 5, 1991

[51] Int. Cl.[5] ..... A45F 5/00

[52] U.S. Cl. ..... 224/218; 224/148; 220/695

[58] Field of Search ..... 224/148, 217-219, 224/222, 267; 132/207, 208, 286, 293; 220/608, 657, 695; D18/14-18; D28/7, 76, 77, 83; 206/581

[56] References Cited

U.S. PATENT DOCUMENTS

| | | | |
|---|---|---|---|
| D. 6,798 | 8/1873 | Cooke | D18/17 |
| 275,780 | 4/1883 | Mahar | 224/217 |
| 706,997 | 8/1902 | Ogborn | 224/217 X |
| 1,281,605 | 10/1918 | Lloyd | 224/219 |
| 1,587,009 | 6/1926 | Bobbe | 132/293 |
| 1,701,496 | 2/1929 | Ellis | 224/217 X |
| 1,714,732 | 5/1929 | Schneider | 224/219 X |
| 1,766,478 | 6/1930 | Baker et al. | 224/218 |
| 1,811,896 | 6/1931 | Ross | 220/657 X |
| 1,827,078 | 10/1931 | Ellis | 224/217 X |
| 2,054,004 | 9/1936 | Sandberg | 132/293 |
| 2,233,859 | 3/1941 | Wick | D28/77 |
| 2,356,722 | 8/1944 | Harris | 224/217 X |
| 2,762,377 | 9/1956 | Stephens | 224/219 X |
| 3,298,561 | 1/1967 | McConnie | 220/695 |
| 3,677,271 | 7/1972 | Luciano | 132/314 |
| 3,701,455 | 10/1972 | Warnecke | 220/608 |
| 4,844,308 | 7/1989 | Porteous | 224/217 |
| 5,088,121 | 2/1992 | Wallace | 224/218 X |
| 5,139,188 | 8/1992 | Scharf | 224/217 |

FOREIGN PATENT DOCUMENTS

| | | | |
|---|---|---|---|
| 0181755 | 1/1918 | Canada | 224/218 |
| 0775819 | 10/1934 | France | 224/219 |
| 0931816 | 3/1948 | France | 224/219 |
| 0932860 | 4/1948 | France | 224/219 |

*Primary Examiner*—Henry J. Recla
*Assistant Examiner*—Casey Jacyna
*Attorney, Agent, or Firm*—Arthur G. Yeager; Earl L. Tyner

[57] ABSTRACT

An open top container attachable to the back of the hand, the container having upwardly directed side walls with adjacent walls having flanges slanting inwardly from the side walls toward the open top.

6 Claims, 1 Drawing Sheet

HAIR TREATMENT SERVICING CONTAINER

BACKGROUND OF THE INVENTION

In the treatment of human hair, it is frequently necessary to apply liquid, semiliquid, or pasty materials directly to the hair by means of a brush or a comb so as to intimately contact every hair in a lock of hair. The hair stylist wishes to do this without dropping any of the treating material on the customer and without getting the stylist's hands in the material. This is difficult to do with only two hands, one of which being needed to stretch out the lock of hair and the other needed to apply the treating material to the hair.

It is an object of this invention to provide a container to hold the hair treating material close to the customer's head for easy application to the hair while leaving both of the stylist's hands free to apply the material to the hair. It is another object of this invention to provide a container that can be worn on the back of a hand leaving the fingers free to do other things. Still other objects will become apparent from the more detailed descriptions which follow.

BRIEF SUMMARY OF THE INVENTION

This invention relates to a container attachable to the back of a hand for holding hair treating compositions; the container having an open top, one or more upstanding side walls, and a bottom; the upper edges of a portion of the side walls having a slanting flange extending from the side wall inwardly toward the open top; and means for detachably attaching the container to the hand of the user.

In specific and preferred embodiments of the invention, the container includes an elastic band or a spring clip device for attaching the container to the back of the user's hand; and the slanting flanges include at least two adjacent flanges that are relatively wide in the direction from the side wall toward the open top.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The features of this invention can best be understood by reference to the attached drawings.

Figure 1:
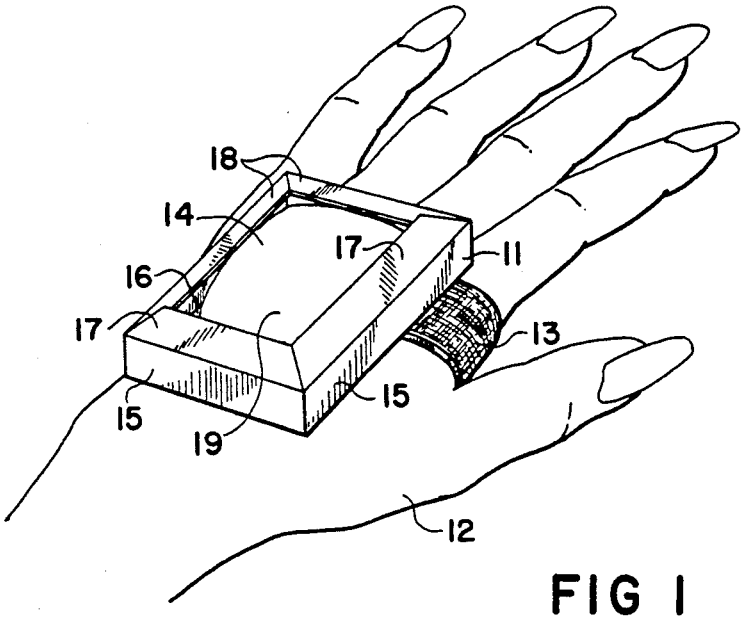
FIG. 1 is a perspective view of the container attached to the user's hand by an elastic band as used in treating hair.

FIG. 1 is an illustration showing how the container of this invention is used. Container 11 is attached to the user's hand 12 by slipping hand 12 into a loop of elastic 13 attached to container 11. Container 11 has an open top 14, a bottom 16, and upstanding side walls 15 such that the container 11 may hold a small amount of a liquid 19 used in treating hair. Liquid 19 might be a dye, a bleaching agent, a relaxant, mousse, or other hair treating material that is normally applied to the hair by dipping a small brush or a sponge into liquid 19 and applying it to a lock of hair.

Container 11 is shown as a rectangular box, but it may be made in other shapes or sizes, e.g., round, oval, square, triangular, or the like.

Figure 2:
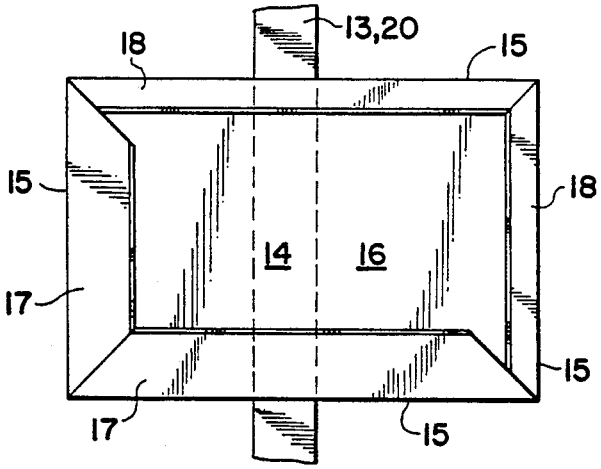
FIG. 2 is a top plan view of the container of this invention.
Figure 3:
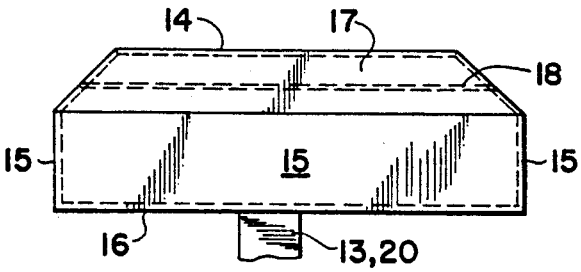
FIG. 3 is a front elevational view of the container of this invention.
Figure 4:
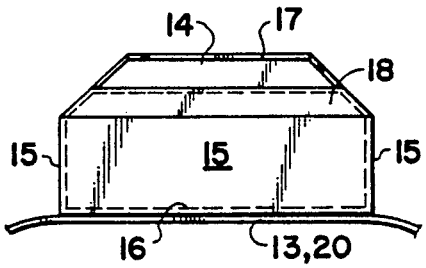
FIG. 4 is an end elevational view of the container of this invention.

The preferred structure of a rectangular container is shown in FIGS. 2–4. Container 11 has a bottom wall 16, four upstanding side walls 15, and an open top 14. To help prevent splashing and to provide a scraping edge against which excess liquid can be removed from a brush, there are slanting flanges 17 and 18 at the top of side walls 15. These flanges 17 and 18 slant inwardly from side wall 15 toward open top 14. This helps to prevent any liquid from splashing over the top edge of walls 15. Flanges 17 and 18 also provide edges against which a liquid-saturated brush may be drawn to allow excess liquid to be scraped off to return to the inside of the container. The exact shape and size of flanges 17 and 18 are not critical. One preferred arrangement is shown in FIGS. 2–4 wherein two adjacent side walls 15 have relatively wide flanges 17, while the other two side walls 15 have relatively narrow flanges 18. Wide flanges 17 are about as wide as the height of side walls 15. Narrow flanges 18 are about one-half as wide as flanges 17. There is nothing critical about these relative widths, since all four flanges could be of equal width and be eminently satisfactory for such a container. Furthermore, flanges 17 and 18 may be planar or convexly arcuate and be equally suitable. As mentioned before, the utilitarian purposes of flanges 17 and 18 are to help in preventing the liquid from spilling over the edges, and to provide a brush scraping edge to remove excess liquid from the applicator brush, sponge, or the like.

Figure 5:
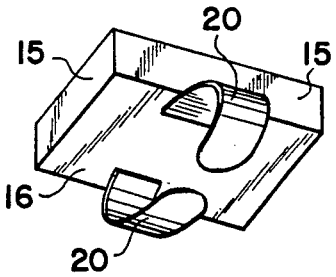
FIG. 5 is a perspective view of the container of this invention showing a spring clip for attachment to the user's hand.

Container 11 is shown in FIGS. 2–4 as having a hand attachment means 13 or 20 attached to bottom 16. The most suitable types are an elastic band or Velcro hook and loop fastener 13 or a pair of spring clips 20. FIG. 1 shows the elastic band or Velcro hook and loop fastener 13 and FIG. 5 shows the spring clips 20. Other means, such as a spot of adhesive, a string that can be tied, a strap that can be buckled, a strap with snap fasteners can be employed in place of those preferred embodiments shown in FIGS. 1 and 4.

The container of this invention may be made in left-hand or right-hand types. Preferably the two wide flanges 18 will be worn adjacent the thumb and wrist of the hand holding the container so as to be the preferred flanges against which the liquid applicator brush can be scraped to remove excess liquid. Depending on whether the user is right handed or left handed, the container may be oriented differently to keep wide flanges close to the thumb and wrist. The overall measurements of the container should be about 1–2 inches wide, 2–3 inches long, and 1–1½ inches high, with the height of flanges 17 about 1–1½ inches above bottom 16 and the height of flanges 18 about ¾–1 inch above bottom 16. The preferred material of construction is plastic.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A container attachable to the back of a hand for holding liquid compositions to be applied by a brush; said container having an open top, a bottom and a plurality of upstanding side walls with a first end connected to said bottom and a second end disposed vertically above said first end, said bottom and said side walls forming a container interior and a means for holding liquid compositions, a plurality of flanges having first and second ends with said flange first ends connected to said second ends of said upstanding side walls and extending upward from said side wall second ends and slanting toward said container interior wherein the entire second ends of each of said flanges form an edge which defines said open top and whereby an applicator brush may be scraped against said edge to remove excess liquid from the applicator brush and means for detachably attaching said container to the hand of the user.

2. The container of claim 1 wherein said means for attaching includes a loop of an elastic band for encircling the users hand.

3. The container of claim 1 which is rectangular in shape with four said side walls and at least two said slanting flanges extending inwardly from two adjacent said side walls.

4. The container of claim 3 wherein all four said side walls have said inwardly slanting flanges.

5. The container of claim 4 wherein two adjacent said flanges are wider in an inward direction than the other two adjacent said flanges.

6. The container of claim 1 wherein said means for attaching includes a spring clip for attachment to the users hand.

* * * * *